US006136177A

United States Patent [19]

Hung

[11] Patent Number: 6,136,177

[45] Date of Patent: Oct. 24, 2000

[54] ANODE AND CATHODE CURRENT MONITORING

[75] Inventor: Oliver K. Hung, North Vancouver, Canada

[73] Assignee: Universal Dynamics Technologies, British Columbia, Canada

[21] Appl. No.: 09/258,101

[22] Filed: Feb. 23, 1999

[51] Int. Cl.[7] ..... C25C 1/00

[52] U.S. Cl. ..... 205/336; 205/337; 204/247.1

[58] Field of Search ..... 205/336, 337; 204/247.1

[56] References Cited

U.S. PATENT DOCUMENTS

| | | | |
|---|---|---|---|
| 4,072,597 | 2/1978 | Morel et al. | 204/247.1 |
| 4,090,930 | 5/1978 | Morel et al. | 205/336 |
| 4,169,034 | 9/1979 | Morel et al. | 204/247.1 |
| 4,786,379 | 11/1988 | Barnett | 205/336 |
| 5,089,093 | 1/1992 | Blatch et al. | 204/67 |
| 5,240,569 | 8/1993 | Waldron | 204/247.1 |
| 5,294,306 | 3/1994 | Howard et al. | 205/336 |

OTHER PUBLICATIONS

Computer Applications in the Electrochemical Industry, IEEE Transactions on Industry Applications, vol. 24, No. 6, Nov./Dec. 1988.

*Primary Examiner*—Bruce F. Bell
*Attorney, Agent, or Firm*—Seed Intellectual Property Law Group

[57] ABSTRACT

The present invention provides a method and apparatus for determining the current densities in an alumina reduction cell by the measuring of magnetic fields without contact with the anodes or cathodes. The current density is modelled by determining the currents in the anodes and/or cathodes by measuring the magnetic field produced by the anodes or cathodes, or the conductors feeding them, and electronically correcting for ambient effects. The apparatus consists of Hall Effect devices to measure the magnetic field and electronics to correct, display, log and analyze the data.

19 Claims, 7 Drawing Sheets

15:00:00

TYPICAL DATA FOR PREBAKE POT

ANODE AND CATHODE CURRENT MONITORING

TECHNICAL FIELD

The invention relates to the field of methods for automated monitoring and control of electrolytic reduction cells in the production of aluminum.

BACKGROUND ART

Alumina reduction cells, in which aluminum is produced electrochemically from alumina, consume tremendous amounts of electricity and operate at very high temperatures, typically 960 degrees C. It is difficult to observe and measure the various physical and chemical states within the cell due to the high temperature the cell being enclosed. Measuring the electrical currents into and out of the cell is one of the few measurable parameters. It is therefore important to monitor the current distribution in the cells to gain more understanding of cell phenomena which will lead to improvements in cell efficiencies and reduction in cell instabilities.

Alumina reduction cells operate with direct, as opposed to alternating currents. The cells have one or more anodes distributing current to the cell, one or more cathodes collecting current from the cell and an electrolyte containing the dissolved alumina. Production facilities contain a number of electrolytic cells electrically connected in series. The anodes and cathodes typically have multiple conductors connected to busses to carry the current to the adjacent cell.

The current carried by each conductor in a cell varies due to physical and electrochemical reasons. Physical reasons include the resistance of the connection between the conductor and the buss, resistance variations depending or the conductor's material and its quality, etc. Electro-chemical reasons include the chemical composition of the electrolyte, depth of the electrolyte between the anode and cathode, etc. Beneath the electrolyte is the molten aluminum product. As the aluminum is produced, the electrolyte composition changes, thereby varying its resistance. The size of industrial electrolytic cells result in non-homogeneous electrolyte composition resulting in variations in the current from conductor to conductor.

The magnitudes of the currents in an industrial cell line create significant ambient magnetic effects, large enough to create movements and instability in the liquid metal bath and electrolyte. These movements will change the depth of electrolyte between the anode and cathode and, as described above, vary the currents in the anodes and cathodes. This results in variations in currents in the conductors connected to the anodes and cathodes.

Various attempts have been made to determine the current distribution in the alumina reduction cell. This has been done by measurement of the direct voltage between two points on the anode, and is typically done using "voltage taps". See for example U.S. Pat. No. 4,786,379 issued to Reynolds Metal Company on Nov. 22, 1988. Voltage taps measure the voltage drop at a fixed distance on the conductor in order to determine the current. This existing method has problems with accuracy and reliability. Measurement of voltage differential is problematical due to the small potential differences between the two points of contact and resistance variations due to the temperature of the conductor. As well, they are significantly influenced by the contact resistance between the probe and the conductor which can vary due to such things as the amount of oxidation and deterioration in the contact. The environment in which the conductors operate is detrimental to maintaining a clean contact.

Other problems with existing methods are: 1) safety concerns with equipment electrically connected to uninsulated conductors at high potential; 2) anodes must be changed periodically which may require that sensors encircling the conductor be removed; 3) reliability of electrical and electronic components in the adverse environment in the immediate vicinity of electrolytic cells; 4) induction from large, ambient magnetic fields into control cabling causing distortion in the signals; 5) cell currents are very dynamic and necessitate snapshots of current density for all conductors within a very short period; 6) unreliability of electronic equipment and wiring within the vicinity of large ambient magnetic fields.

DISCLOSURE OF INVENTION

The present invention provides a method and apparatus for determining the current distribution in an alumina reduction cell by the measuring of magnetic fields without electrical contact with the anodes or cathodes. The currents in the anodes and/or cathodes are determined by measuring the magnetic field produced by the anodes or cathodes, or the conductors feeding them, and electronically correcting for ambient effects.

BRIEF DESCRIPTION OF DRAWINGS

In drawings illustrating a preferred embodiment of the invention.

BEST MODE(s) FOR CARRYING OUT THE INVENTION

Figure 1:
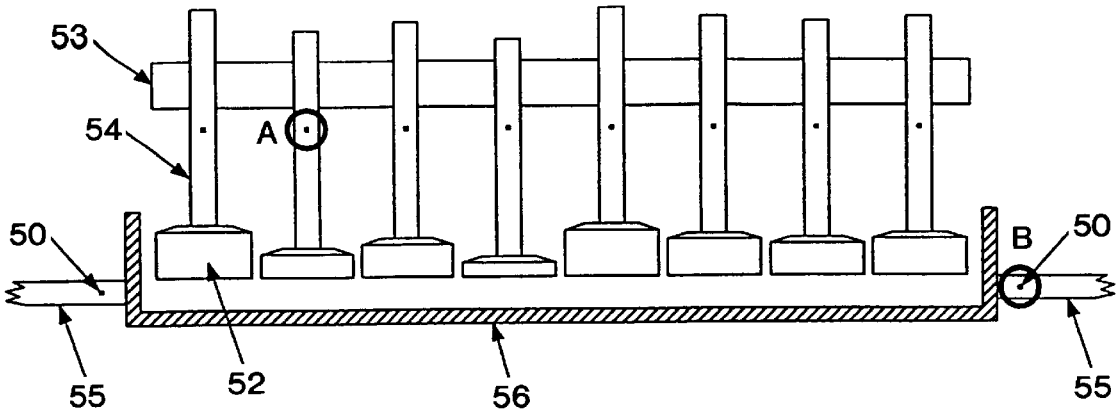
FIG. 1 is a front elevational view, partly in cross-section, of an alumina reduction cell employing sensors according to the present invention.
Figure 2:
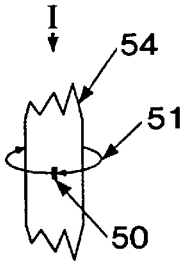
FIG. 2 is a detail of area A of FIG. 1 showing a portion of the anode and a sensor.
Figure 3:
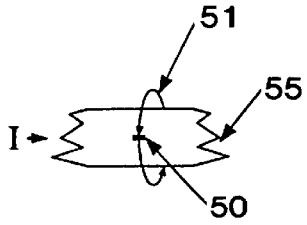
FIG. 3 is a detail of area B of FIG. 1 showing a portion of the cathode conductor and a sensor.

FIG. 1 illustrates an alumina reduction cell 10 of the pre-bake anode type, having anodes 54 which are attached to beam 53. Beam 53 provides current to, and support for, the anodes 54. Each anode 54 supports a carbon block 52, which is consumed during the electrolytic process. The beams 53 travel vertically during normal operation of the cell 10. The anodes 54 are adjustable relative to the beams 53 and must be periodically replaced and adjusted as carbon 52 is consumed. The shell 56, which contains the molten aluminum and electrolyte, has the cathode conductors 55 attached to it. Industrial alumina reduction cells are connected in series so that electrical busswork connects the beams 53 of one cell to the cathode conductors 55 of an adjacent cell. Multiple anodes 54 and cathode conductors 55 are typical, however, some technology utilizes multiple anodes 54 feeding a single carbon block.

Figure 4:
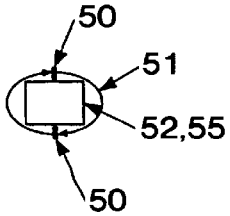
FIG. 4 shows a dual sensor configuration.
Figure 6:
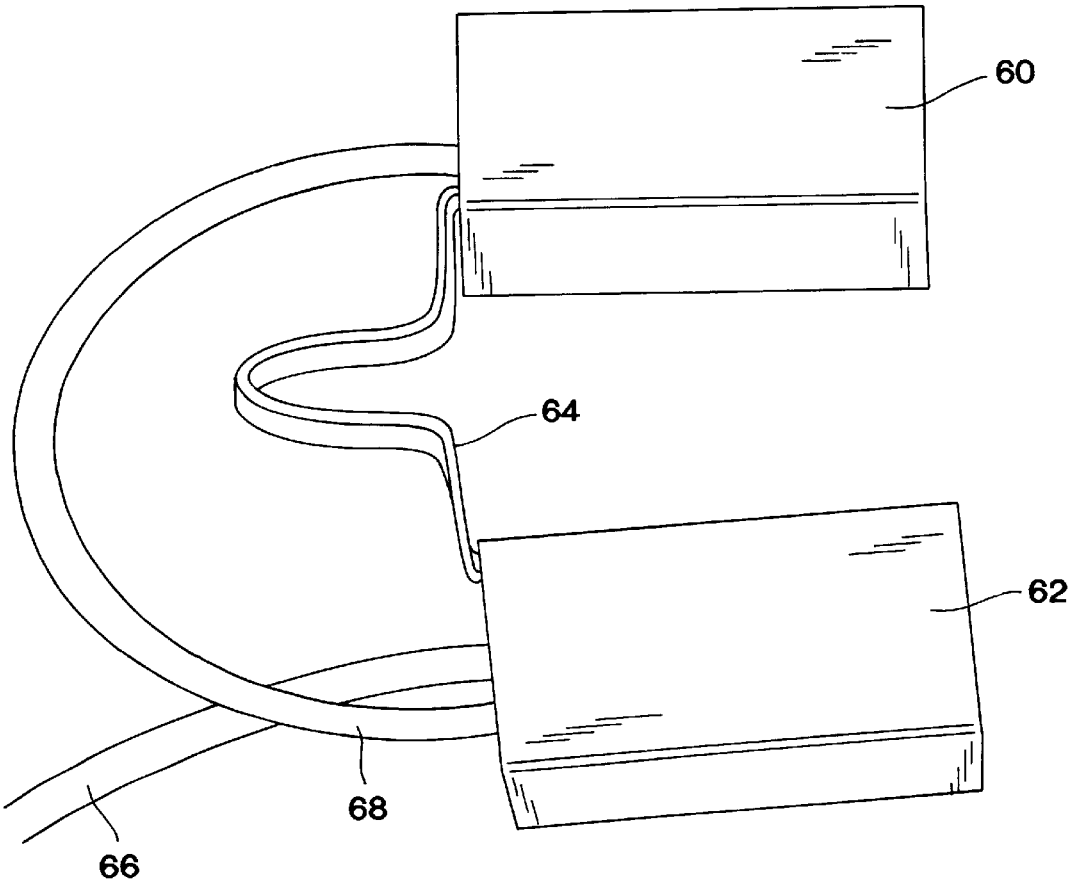
FIG. 6 is a perspective view from above of the sensors of the invention.

Hall Effect sensors can be used to determine the current in a conductor by measuring the magnetic field produced by the conductor. The present invention uses Hall Effect sensors 50 to measure the magnetic field, indicated as 51, in the vicinity of the anodes 54 and/or cathode conductors 55. The Hall Effect sensors 50 are sealed integrated chips which are mounted adjacent to, but electrically insulated from, the conductor whose current is being measured. As shown in FIG. 6 for example, two Hall Effect sensors (not shown) are each mounted inside a piece of rectangular aluminum tubing 60, 62, each about 3 inches long. The sensors are insulated and spaced from the sides of the tubing 60, 62 by filling the tubing, and surrounding the sensors, with potting compound The two pieces of tubing are spaced apart in parallel relationship, and biassed towards each other, by a leaf spring 64. The sensors can then be clipped to the anode by spreading the two pieces of tubing 60, 62, placing them around the anode, and releasing them so that the leaf spring 64 causes the sides of the tubing 60, 62 to bear against the anode. Alternatively, a single sensor 50 could be glued or otherwise secured in an insulated manner to the beam 53 adjacent anode 54. The Hall Effect sensors operate from a low voltage, direct current power supply through conductors 66, 68 and produce an amplified output voltage, also communicated through conductors 66, 68, which is proportional to the strength of the magnetic field. The output of the sensors can be either directly wired to the controller microprocessor, or transmitted by radio signal. Ferrous or similar materials are not utilized to concentrate, focus or redirect the magnetic field 51. Multiple Hall Effect sensors 50 may be used to enhance the measurement of the magnetic field 51 around the conductor as well as better determining the ambient magnetic field in the vicinity of the conductor. By using pairs of sensors configured as shown in FIG. 4, the signal due to ambient flux is cancelled and the resultant signal is proportional only to the magnetic field produced by the anode. By mounting one sensor so that its signal increases as the magnetic field increases, and another sensor so that its signal decreases as the magnetic field increases, a differential signal is derived which cancels the ambient field. A single sensor for each anode also produces useful results, and even a single sensor for an entire cell will assist the diagnostic process.

The outputs of the Hall Effect sensors 50 are communicated to one or more microprocessors (not shown) to correct for the ambient effects specific to the arrangement as well as other environment effects, such as temperature, and to convert the magnetic field measurements to currents. Alternatively the compensation for temperature and ambient fields can be carried out on board the sensor chip, if necessary. The equipment does not rely on electrical contact with the conductor for measurement of its current.

The invention thus permits the simultaneous determination of currents in anodes 54 and/or cathode conductors 55 and any other buss or current carrying conductor connected to the cell. "Simultaneous" does not necessarily mean at the exact same time but means sufficiently fast enough to reasonably determine the conditions during the process changes encountered. This equipment can be installed on single or multiple alumina reduction cells as an analysis and/or production and control tool. The system can display the currents within the conductors and also detect, through criteria defined specifically for the process, events occurring in the process. These events can be used to alert operators and/or control process parameters. The system can be hard wired, utilize radio signals or fibre optics or any combination of these for the communication between the various components.

Figure 5A:
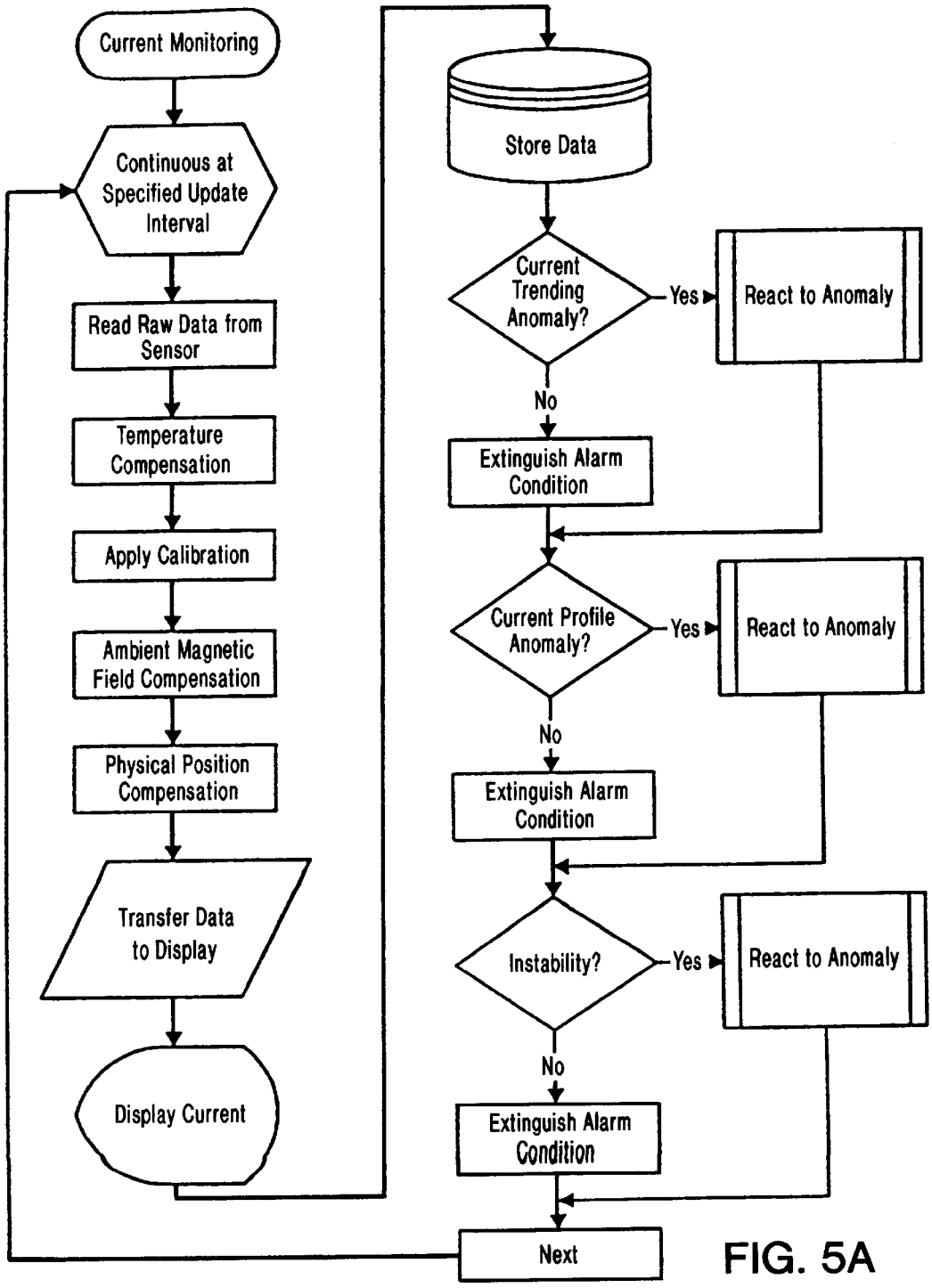
FIGS. 5A, 5B and 5C are flow charts illustrating the method of the invention.
Figure 5B:
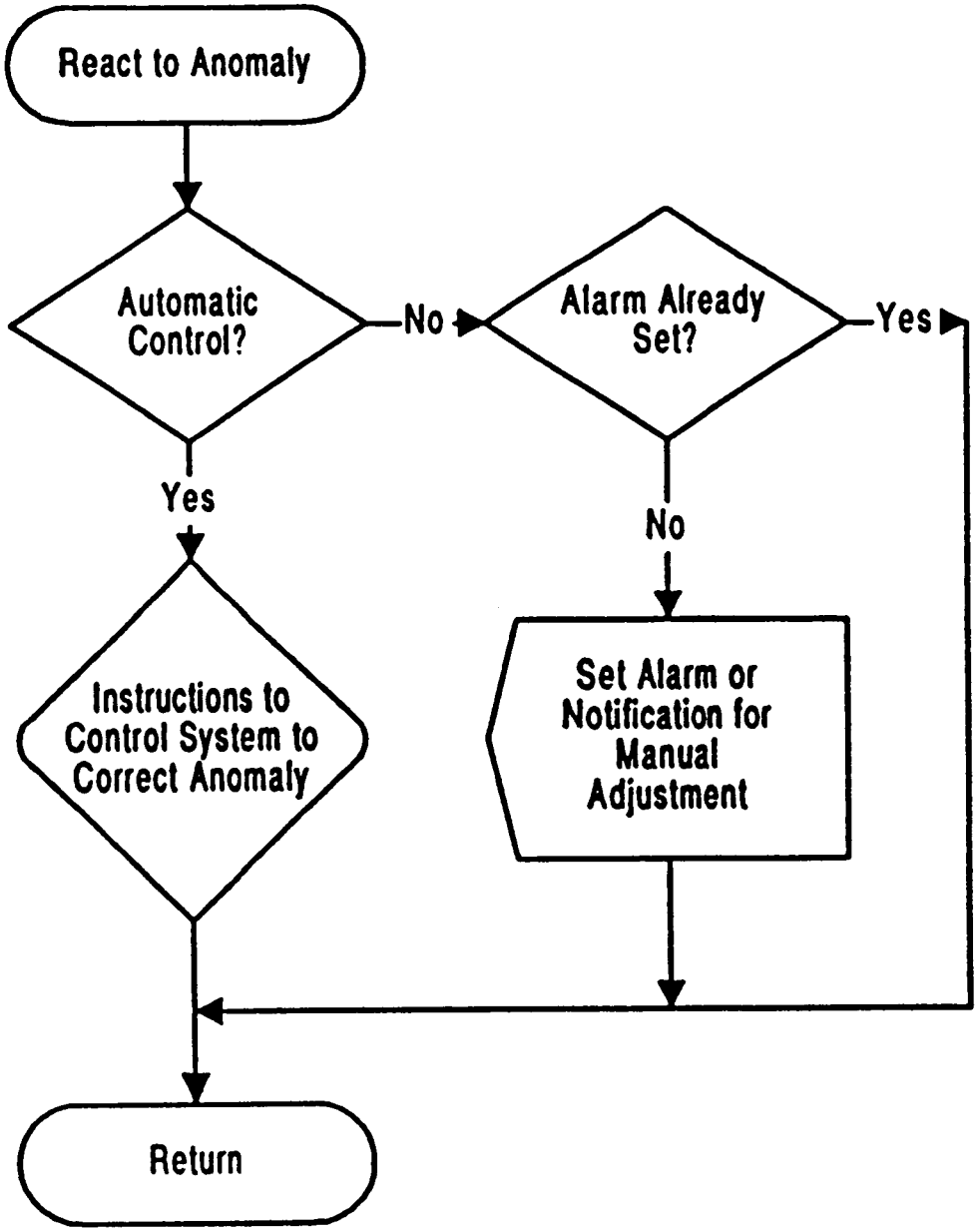
Figure 5C:
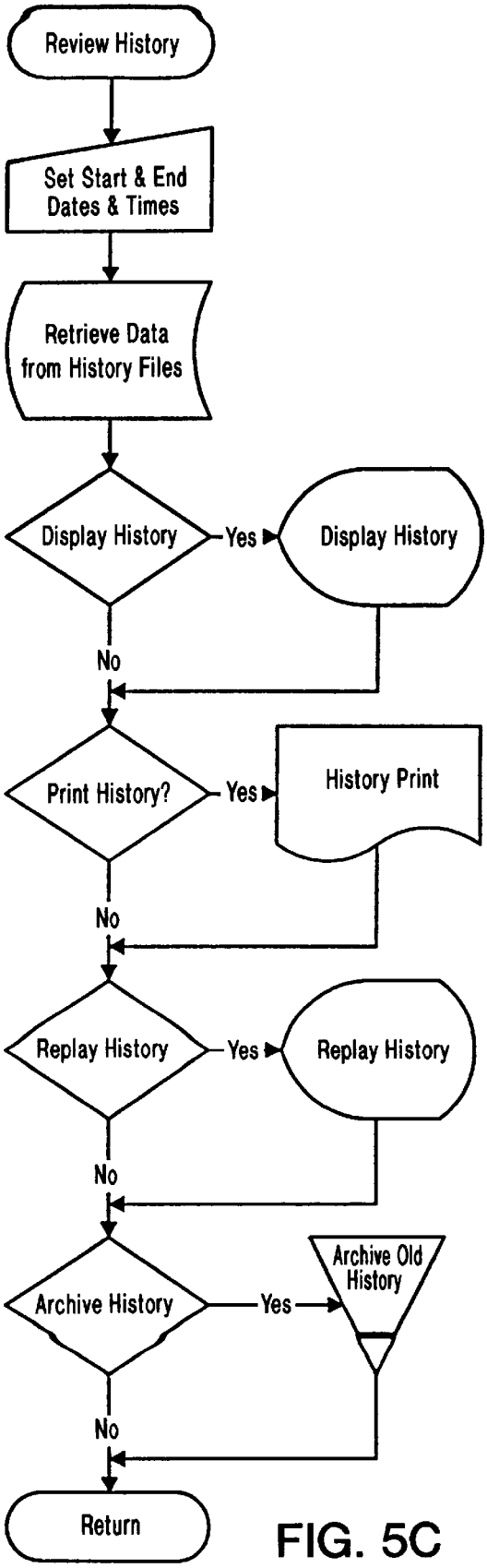

FIGS. 5A, 5B and 5C illustrate by means of flowcharts the method by which the invention achieves the control of the aluminum production process. As illustrated in FIG. 5A, the raw data measurements of the current are corrected, displayed and stored. The raw data is calibrated and compensated for temperature, ambient magnetic fields and physical position of the sensor. If the central processor determines there is a current trending anomaly, current profile anomaly, or instability, then the reaction to anomaly steps shown in FIG. 5B are followed. If the system utilizes automatic control, the control system corrects the anomaly. If the system utilizes manual control, an alarm is activated to notify operating personnel for manual adjustment. FIG. 5C illustrates the steps for historically reviewing the data.

Figure 7:
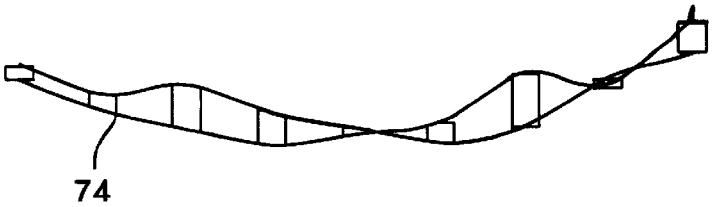
FIGS. 7 and 8 illustrate a computer display of the current monitoring data.
Figure 7:
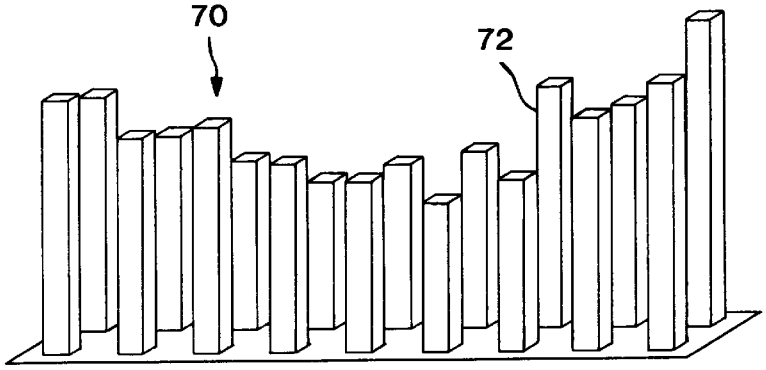
Figure 7:
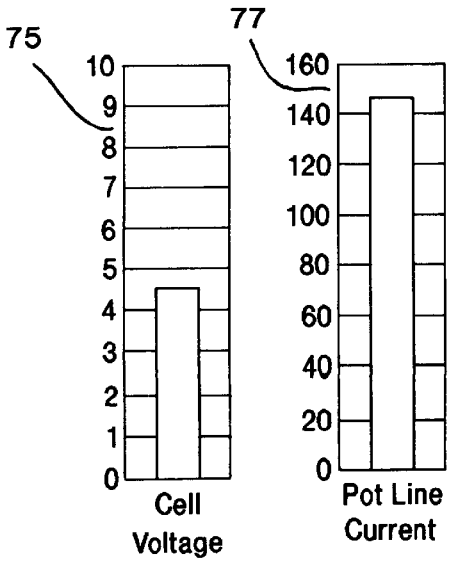
Figure 8:
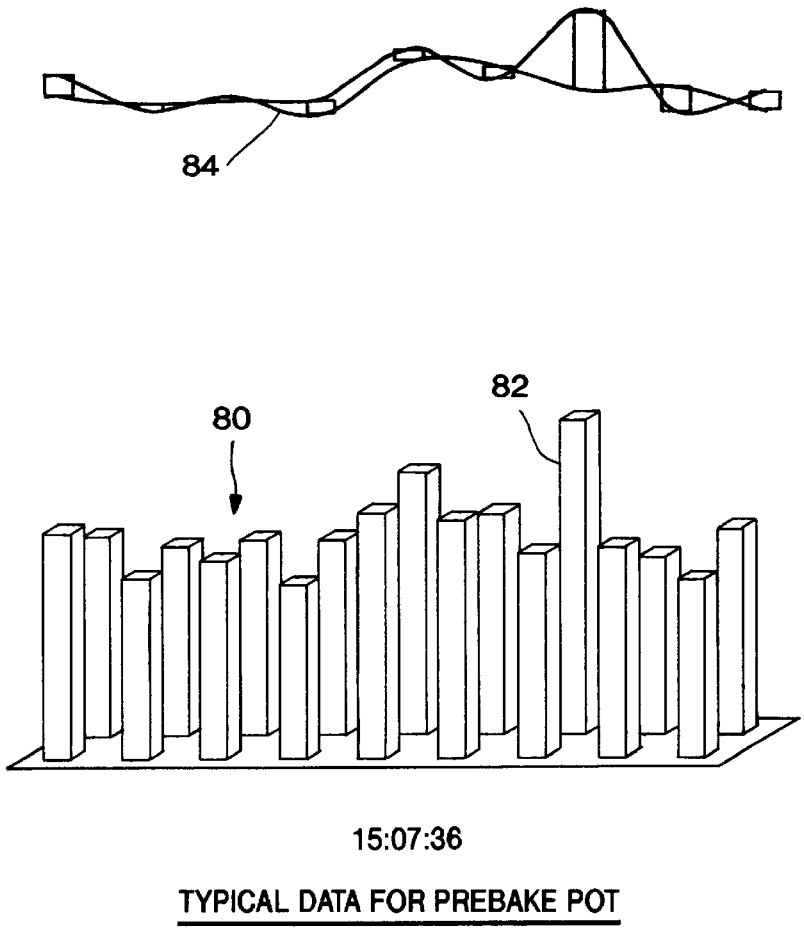

Real time or historical data can be displayed on the controller computer screen using, for example, bar graphs 70, 80 as shown in FIGS. 7 and 8 to provide a visual image of the current patterns and charts showing trending. Historical data storage and retrieval permits display, analysis, charting and replay of the data. The data may be used for determining the resistance through each current carrying conductor. The historical data may be replayed at real time or at accelerated or retarded rates to enhance the ability of the viewer to detect patterns such as waves, instabilities or other events in the cell. As shown in FIGS. 7 and 8, the current levels for each of the anodes in a cell is indicated by a separate bar 72, 82 arranged in accordance with the position of each anode in the cell. A separate graph 74, 84 shows the differential between the current in the front and rear anodes. By displaying the current levels at successive time intervals, patterns can be seen visually, for example the development of a wave pattern as seen in FIGS. 7 and 8. Charts 75, 77 display the cell voltage and pot line current to correlate to the current measurements in the individual anodes or other conductors.

If instabilities in the alumina reduction cells are detected, then the operator is alerted by alarm or the like, and/or the instabilities are dampened by the control logic. Instabilities are in part a function of the alumina concentration in the electrolyte and can be damped by the addition of alumina. Monitoring the location and magnitude of the instability allows the control logic to inform the operator of the preferred location for alumina addition or to inform the automated alumina addition system of the preferred location and interval. Instabilities are also a function of the anode-cathode gap in the aluminum cell. The anode-cathode gap can be optimized by continuously monitoring the electrical current distribution so the anodes can be physically located to match a preferred profile and, by detecting instabilities, alert operators to make manual adjustments or provide control logic to cause automatic adjustments to the anodes as a group or individually. In addition, the molten aluminum depth has an influence on a cell's stability. This depth can be optimized using the protocols listed above to minimize cell instabilities.

Early detection of the onset of anode effects through detection of current drift of individual anodes and/or conductors can result in the alerting of operators or control of the process to limit the quantity and duration of anode effects to predetermined amounts. Periodic short circuits caused by cathode and anode contact, broken pieces of carbon or other electrically conducting materials can be detected and an operator alerted. The baking of new or refurbished alumina reduction cells can be optimized by determining the current distribution in electrodes supplying the cell, and thereby determining the total energy supplied through each electrode, and controlling the energy distribution to avoid thermal stresses. Further, the anode life can be determined by totalling the power carried by a given anode and alerting operators when the anode is calculated to be completely consumed, as well as optimizing the schedule for replacement of the anodes.

The invention was used in an aluminum smelter to determine and monitor the currents in each of the conductors, or anode stems, feeding the anode of a single cell. Snapshots of the currents in each of the conductors were made at predetermined intervals consistent with the needs of the process. These currents were displayed on real time basis as well as being historically logged. The system can be hard wired, utilize radio signals or a combination of both for the communication between the various components. The operators were able to use the real time display to view the current distribution in the cell and, as a result, make manual adjustments to the cell in order to obtain their desired current distribution. Historical trending was utilized to determine longer term effects of varying operational parameters and alert the operator when conditions went outside predefined values. The history can be retrieved and played back at different rates for detailed analysis of cell behaviour.

The system can be used on multiple cells in alumina reduction facilities. Based on the number of conductors attached to each anode and cathode in a cell, it will be necessary to employ microprocessors to analyze the large quantity of data produced. The system will allow the operators to select any cell or cells for which they want a real time display or will automatically switch to display a cell which is operating abnormally. As well, the system will monitor changes in the cell and cause process changes based on a predetermined definition specific to the operation as well as alert the operator should human interaction be required.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method of determining the current distribution in one or more alumina reduction cells by i) providing one or more sensors adapted to measure the magnetic field in the vicinity of each of one or more conductors carrying electrical power to or from the cell and to generate one or more signals proportional to said magnetic fields; (ii) communicating said signals to a remote control device; iii) compensating said signals for ambient magnetic effects and temperature either before or after said communication step; and iv) generating control signals to said reduction cell based on said signals.

2. The method of claim 1 wherein said one or more sensors are each located in the vicinity of an anode.

3. The method of claim 1 wherein said one or more sensors are each located in the vicinity of a conductor canning electrical power to an anode.

4. The method of claim 1 wherein said one or more sensors are each located in the vicinity of a cathode.

5. The method of claim 1 wherein said one or more sensors are Hall effect sensors.

6. The method of claim 5 wherein said Hall effect sensors are mounted on electrically insulating material secured to an anode.

7. The method of claim 1 wherein said control signals alert an operator when an instability occurs.

8. The method of claim 1 wherein said control signals provide control logic for dampening an instability.

9. The method of claim 1 wherein said controller determines the preferred location and interval for alumina addition and control signals provide control logic for an automated system to add alumina at the preferred location and interval.

10. The method of claim 1 wherein said controller determines the anode life by totalling the power carried by the anode and control signals provide control logic alerting an operator when the anode is completely consumed and must be changed.

11. The method of claim 1 wherein said controller optimizes the distance between the anode and cathode in an aluminum cell by continuously providing the electrical current distribution so anodes can be physically located to match a preferred profile, and detecting instabilities and providing control logic to cause automatic adjustments to the current carrying conductors and/or providing control logic to cause automatic additions of alumina.

12. The method of claim 1 wherein said controller detects anode effects by detecting the drift of individual current carrying conductors and alerts an operator or controlling the process to eliminate the anode effects.

13. The method of claim 1 wherein said controller detects periodic short circuits and alerts an operators upon such detection.

14. The method of claim 1 wherein said controller optimizes the baking of alumina reduction cells by determining the energy distribution in electrodes supplying the cell and the total energy supplied through each electrode and displays energy distribution to operators for manual adjustments, or controls the energy distribution during the baking of the cell to avoid thermal stresses in the cell.

15. A method of determining the current distribution in one or more alumina reduction cells by i) providing one or more sensors adapted to measure the magnetic field in the vicinity of each of a one or more conductors carrying electrical power to or from the cell and generating one or more signals proportional to said magnetic fields; (ii) communicating said signals to a remote control device; iii) compensating said signals for ambient magnetic effects and temperature either before or after said communication step; and iv) continuously displaying an image representative of the values of said one or more signals.

16. The method of claim 15 wherein said display is in real time.

17. The method of claim 15 wherein said display provides a replay of historical data.

18. The method of claim 17 wherein said replay of historical data is at accelerated or retarded rates.

19. The method of claim 15 wherein said display comprises a bar graph wherein each bar represents the level of the current in an anode.

* * * * *

UNITED STATES PATENT AND TRADEMARK OFFICE

CERTIFICATE OF CORRECTION

PATENT NO : 6,136,177
DATED : Oct. 24, 2000
INVENTOR : Oliver K. Hung

It is certified that errors appear in the above-identified patent and that said Letters Patent are hereby corrected as shown below:

Claim 3, column 5, line 53, "canning electrical" should read --carrying electrical--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*